United States Patent [19]

Lloyd

[11] 4,304,381

[45] Dec. 8, 1981

[54] AIMABLE MOUNTING APPARATUS

[75] Inventor: Wayne B. Lloyd, Baltimore, Md.

[73] Assignee: Westinghouse Electric Corp., Pittsburgh, Pa.

[21] Appl. No.: 122,332

[22] Filed: Feb. 19, 1980

Related U.S. Application Data

[63] Continuation of Ser. No. 947,240, Sep. 29, 1978.

[51] Int. Cl.[3] ..... B61L 3/00

[52] U.S. Cl. ..... 248/179; 343/765

[58] Field of Search ..... 248/179, 180, 183, 184, 248/185, 278, 284; 343/757, 765, 766; 350/82, 83, 85; 33/236, 268

[56] References Cited

U.S. PATENT DOCUMENTS 2,437,251 3/1948 Frische et al. ..... 343/757 X 2,551,180 5/1951 Starr et al. ..... 248/183 X

*Primary Examiner*—William H. Schultz

*Attorney, Agent, or Firm*—H. W. Patterson

[57] ABSTRACT

A disc-shaped member-to-be-aimed is mounted for tilting about two mutually perpendicular tilt axes rotatable about a third and mutually perpendicular boresight axis that affords a conical field of view for the member in the presence of any asymmetry in its tilting about the tilt axis. A multi-gimbal assembly accommodates such multiple-axis movement freedom, and torque motors disposed in an axialwise direction at one side of the member-to-be-aimed affords radial compactness for the gimbal assembly.

8 Claims, 5 Drawing Figures

AIMABLE MOUNTING APPARATUS

This is a continuation of application Ser. No. 947,240, filed Sept. 29, 1978.

BACKGROUND OF THE INVENTION

1. Field of the Invention

Aimable mounting apparatus such as for air or space borne use.

2. Description of the Prior Art

Wraparound-type power-driven gimbals are employed in aimable mounting apparatus, for example, for the pointing of directional members such as antenna elements, sensors, etc. within in a conical field of view about a central or boresight axis. In many cases it is an advantage to minimize the diametral dimension about the boresight axis in which the gimbaled system functions, and to maximize the field of view. Conventional powered-type gimbal mount systems tend to render such objectives difficult to obtain, due to the nature and arrangement of components.

SUMMARY OF THE INVENTION

The present invention mounts the directional member at the center of a cylindrical roll gimbal through the medium of a central ring gimbal and a pair of mutually perpendicular axes-defining rotary support shaft means. By use of a torque motor for the roll gimbal, a reactor rod rotably coupled to the center of the roll gimbal, a torque motor on the directional member, and a torque motor on the roll gimbal for the ring gimbal, a conical scan for aiming of the directional member is provided in a highly compact assembly within an envelope defined by the outer periphery of the roll gimbal.

DETAILED DESCRIPTION OF A PREFERRED EMBODIMENT OF THE PRESENT INVENTION

The present invention utilizes an external gimbal arrangement for the mounting of the member to be aimed. To overcome the beam obscuring problem, travel about the innermost tilt axis, the auxiliary axis, AA is limited to $+15°$, $-30°$ with a very slight forward overhang of the payload. To achieve wide solid angle coverage a three-axis (roll axis, RA, traverse axis, TA, and auxiliary axis AA) gimbal arrangement is used. In behalf of minimizing radial size of the assembly, drive components are placed aft of the member-to-be-aimed rather than along side it, as will be described subsequently. This is straightforward for the middle gimbal drive, but requires a special technique for the inner gimbal drive. This inner gimbal drive forms an essential and basic part of the present invention.

For the common shapes of members to be aimed, disc, dish, elongated cylinder, etc., the minimum swept volume and hence minimum frontal area results when such member is gimbaled around axes which pass through the geometric center of such members. For example, the axes of a three-axis gimbal for a disc-shaped member of thickness t should intersect at the center of the disc at a distance t/2 from the front of the disc. This optimum location of gimbal axes is achieved by external ring gimbals, and the size of the gimbals per se are made minimum, with the drive components positioned to eliminate influence on the radial dimension of the gimbal rings.

Figure 1:
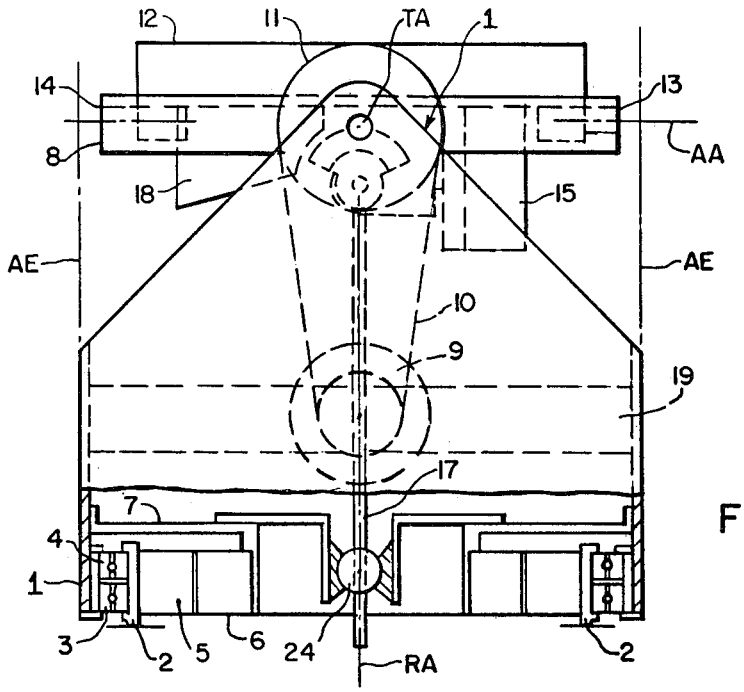
FIG. 1 is a plan view, partly in outline and partly in section showing schematically what is presently contemplated to be a preferred embodiment of the invention.

Referring to FIG. 1 of the drawings, the embodiment of the invention illustrated therein comprises a roll gimbal 1 which is in generally cylindrical configuration and is mounted for rotary movement about a roll axis RA on such as a missile frame 2 by preloaded ball bearings 3 and 4. A DC torque motor is provided for effecting rotary movement of the roll gimbal 1 about the roll axis RA. The motor includes a stator 5 attached to the missile frame 2 and a rotor 6, attached by means of a torque-transmitting diaphragm 7 to the roll gimbal 1. A ring-shaped traverse gimbal 8 is mounted at the forward end of the roll gimbal 1 for pivotal movement about the traverse axis TA. A traverse axis drive for the traverse gimbal 8 is provided by torque motor 9 driving through a metal belt 10 to a pulley 11 which is integrally attached to such traverse gimbal. Freedom for movement of the member-to-be-aimed 12 about an auxiliary axis AA perpendicular to the traverse axis TA, is provided by pivotally mounting such member 12 on the traverse gimbal 8 by means of journals or pins 13 and 14 which are attached to said member 12. The member-to-be-aimed 12 is driven about the traverse axis TA together with the traverse gimbal 8 by operation of an auxiliary axis torque motor 15 that is provided with a directly coupled position pickoff 16. This torque motor has its outer housing, its stator, fixed to the member-to-be-aimed 12, and its rotor is reacted with the roll gimbal 1 at its center through the medium of a torque reaction rod 17 slidably mounted in the center of a ball bearing 24 at such center.

Figure 2:
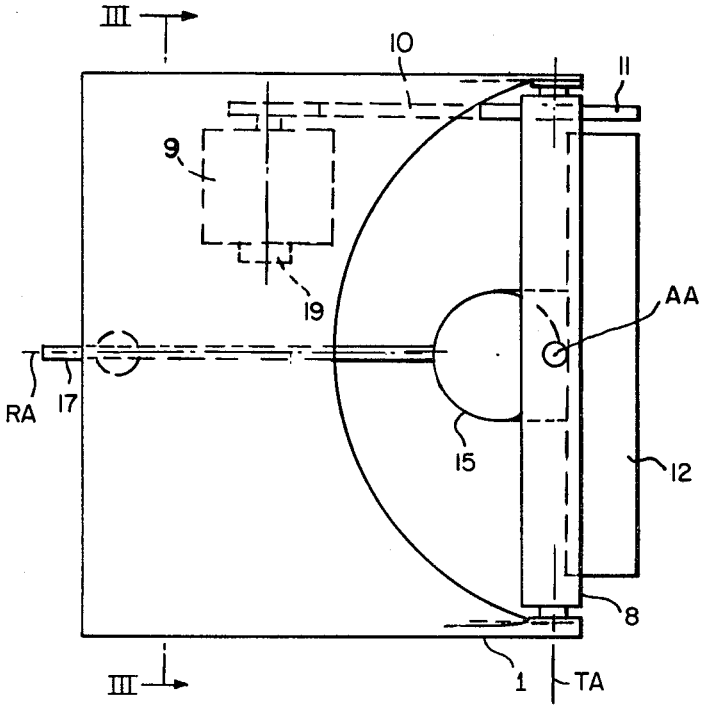
FIG. 2 is a side elevation view of the embodiment of the invention shown in FIG. 1.

A gyro counterweight 18, and other counterweights (not shown), as may be required, are provided to maintain static balance around the gimbal axes. FIG. 2 shows a side view of the apparatus of the present invention. In FIG. 2 the angular travel of the member 12 about the auxiliary axis AA is exemplified as being limited to approximately $+15°$ and $-30°$ off a boresight which corresponds with the roll axis RA. In the configuration as exemplified herein the pointing within a 70°-conical field of view can be accomplished by effecting movements of the components about the roll and traverse axes RA and TA only, without movement about the auxiliary axis AA, which is provided to avoid any problem that may be presented by aiming at or near the pole-straight-ahead direction. In the arrangement provided herein, near the straight-ahead position of the member 12, it is contemplated that the system will operate as having two degrees of freedom for movement about the traverse axis TA and the auxiliary axis AA only, the roll axis RA being intentionally ignored until a prescribed off-boresight angle is obtained.

Figure 3:
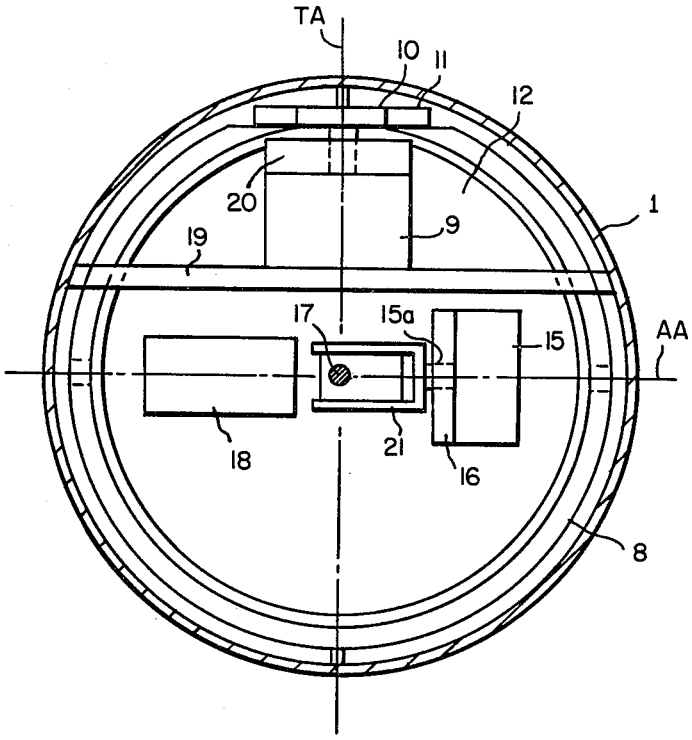
FIG. 3 is a rear elevation section view of the embodiment of the invention taken along the line III—III in FIG. 2; and, FIGS. 4 and 5 are plan views showing two different operational positions of a novel reaction rod and torque motor drive arrangement embodied in the present invention for actuation of the member to be aimed about one of the principal axes.

Referring to FIG. 3, from the rear view depicted therein, it can be seen how the roll gimbal 1, the traverse gimbal 8, the auxiliary axis torque motor 15, the traverse drive pulley 11, and the traverse axis torque motor 9 interrelate. Details of the traverse axis drive are shown therein as including a mounting member 19 for the torque motor 9, which mounting member 19 is affiliated with the roll gimbal 1 and extends across the interior thereof. A traverse angular position pickoff 20 is mechanically coupled to torque motor 9 by such as gearing (not shown) suitable to yield one-to-one-to-one motion of the pickoff and the traverse motor output shaft. An auxiliary axis device or drive fork 21 is also shown attached to the forward end of the output shaft 15*a* of the torque motor 15, which shaft 15*a* extends parallel to the auxiliary axis AA.

Figure 4:
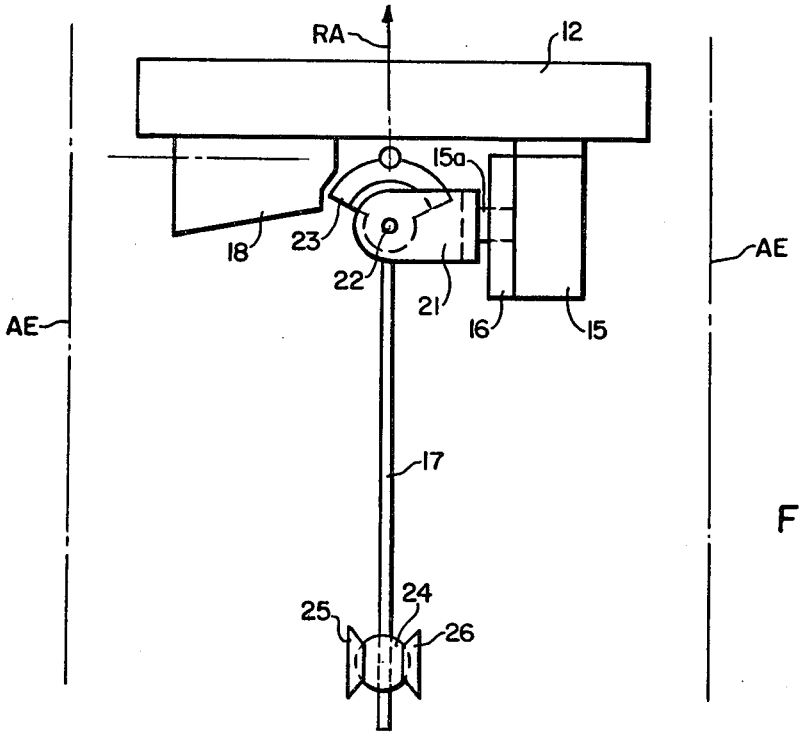

FIG. 4 shows a top view of the auxiliary axis drive mechanism with the roll axis aligned with the boresight axis BA. The basic elements in this drive are the torquer 15, the drive fork 21, the pivoted reaction rod 17, the reaction rod journal 22, reaction rod counterweight 23, the pierced ball 24, and the spherical-sector sockets 25 and 26 for such ball 24. The spherical-sector sockets 25 and 26 are attached to the roll gimbal 1 by way of an annular mounting member affiliated with the diaphragm 7, shown in FIG. 1, and the ball 24 is free to rotate in any direction within such sockets. The reaction rod 17 is free to slide within the central opening that passes through the ball 24. The reaction rod pivots with respect to the device or drive fork 21 by means of a pin or journal 22. The center of gravity of the reaction rod 17 is made to occur at the pivot axis of the journal 22 by means of a counterweight 23. This means that in obtaining static balance of the parts that pivot on the auxiliary axis AA, the reaction rod 17 can be considered to be a fixed mass at a fixed location on the body that pivots around the auxiliary axis. Noting that the housing of the torque motor 15 is fixed to the member 12 and that the rotor of this torque motor drives the fork 21 through the medium of the output shaft 15*a* of such rotor, it can be appreciated that the torque motor output shaft can react against the roll gimbal 1 while the member 12 is moving about the auxiliary axis AA in either direction. In this circumstance there will be some sliding of the rod 17 within the ball 24.

Figure 5:
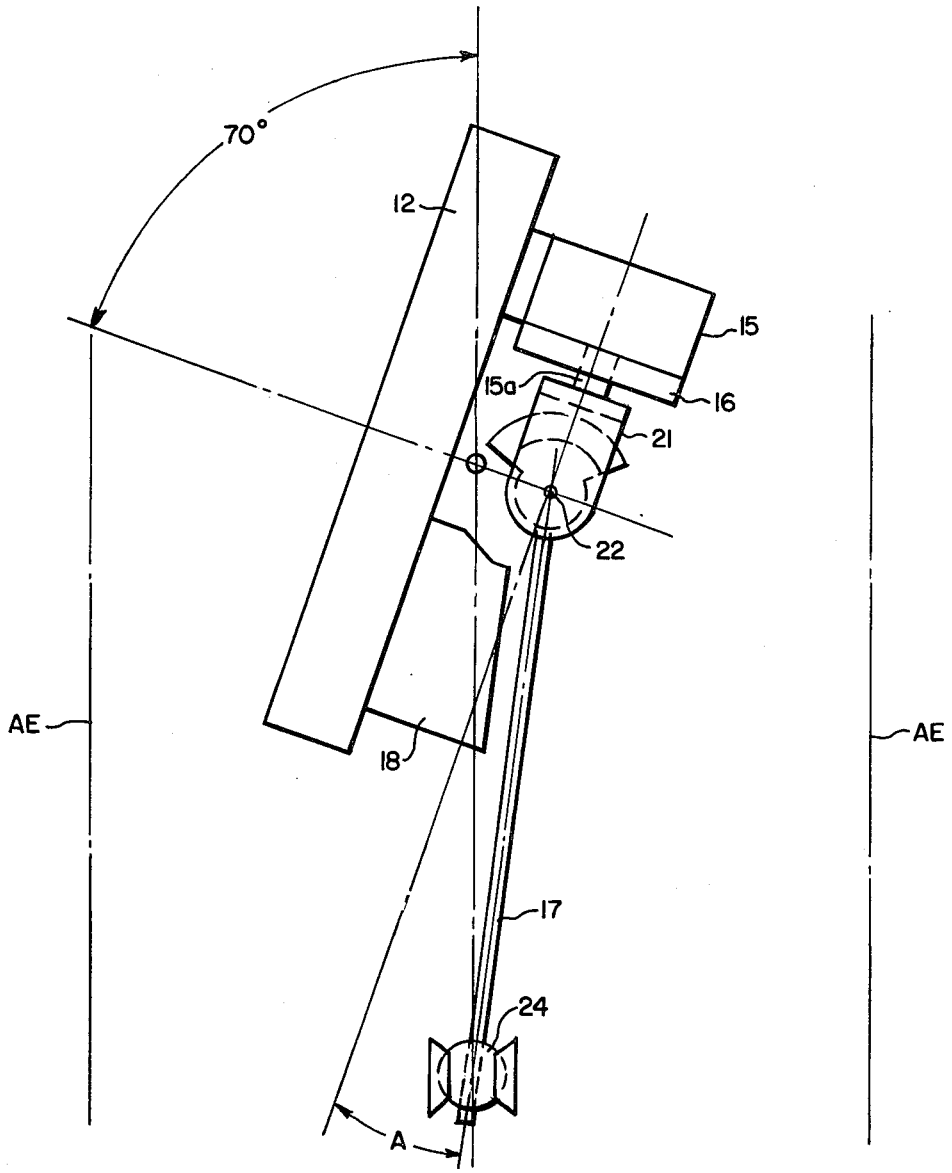

FIG. 5 shows the auxiliary axis drive mechanism in the maximum off-boresight position. In this position the traverse axis has moved 70° counterclockwise off boresight. It will be seen that considerable relative rotation of the rod 17 around the axis of journal 22 has occurred. However, it is still possible for the torque from motor 15 to drive the fork 21 to be reacted to the roll gimbal 1 through the medium of the ball 24. The effective radius arm for this reaction has been reduced from the on-boresight length of rod 17 to the indicated dimension A, but this is adequate for the purpose and it simply means that for a given torque from the torque motor 15, any reaction force of the rod 17 against the ball 24 can be higher than it is in the boresight attitude of member 12.

The embodiment described in the foregoing and shown in FIGS. 1 through 5 can be balanced around all three axes for all possible angular positions. The construction is therefore suitable for operation under high g-loads. Action of the balanced reaction rod drive under g-loading can be understood by visualizing a five-step sequence of events as follows: (1) Removal of the subassembly shown in FIG. 4 from the overall gimbal arrangement; (2) removal of the pierced ball 24 in sockets 25 and 26 so as to create free space around the corresponding end of the rod 17; and (3) balance of the rod 17 by means of a counterweight 23 and other suitable counterweights, if needed, so that the center of gravity of the rod 17 (plus its integral counterweight) falls precisely on the intersection of the pivot axis 22 and the fork axis 21. It is now apparent that the reaction rod 17 will not rotate when the subassembly is accelerated in any of the three translational degrees of freedom. For all practical purposes it can be considered to be a point mass located at the intersection of axis 22 and the axis of fork 21.

Now assume that the subassembly of FIG. 4 is placed into the overall assembly, but again omitting the sphere 24 and sockets 25 and 26. Since the reaction rod is equivalent to a point mass at a fixed location, it can be seen that ideal balance of the gimbaled member 12 and the traverse gimbal 8 can be achieved by suitable counterweights. The entire gimbaled assembly can be made immune to adverse influence of translational g-loading in any possible direction.

Now assume that the pierced ball 24 and its sockets 25 and 26 are repositioned in affiliation with the reaction rod 17 in extension through such ball 24. It will be apparent that such repositioning does not alter the aforementioned immunity to g-loading. It merely provides a place for the rod 17 to react against when torque is applied by the torque motor 15. Any radial force imposed by rod 17 in the bore of the ball 24 is determined not by g-loading, but rather by torque developed by operation of the auxiliary axis torque motor 15. The change and distance between the pivot 22 and ball 24 (apparent in comparison of FIGS. 4 and 5) may, at first inspection, be interpreted as a change in length of a balanced element, and hence a change in balance, but in view of the foregoing remarks, it will be seen that such is not the case.

The reaction rod proportion shown in FIGS. 1 through 5 are conceptual only and do not represent finished design proportions. It is believed feasible (with suitable reaction rod cross section and material, and possible variation of the section with length) to achieve adequate stiffness for excellent servo-loop response. Backlash can be controlled by use of preloaded ball bearings for journals and by a preloaded ball bushing for the indicated sliding joint in sphere 24. Again it is submitted that the sphere 24 is conceptual. It could be replaced by a small two-axis gimbal with preloaded ball-type journal bearings.

Having described the invention, what is considered to be new and desired to be secured by U.S. Letters Patent is:

1. A directional assembly comprising:

a generally cylindrical roll gimbal rotatable about a boresight axis at its center;

a member-to-be-aimed mounted on said roll gimbal for tilting about a tilt axis perpendicular to said boresight axis;

a torque motor mounted on said member-to-be-aimed at one side thereof;

said torque motor having a rotary output shaft extending radially inward toward said boresight axis;

a reaction rod extending generally along said boresight axis;

device means connecting one end of said reaction rod to said output shaft; and, means at the center of said roll gimbal in axialwise and radialwise sliding cooperation with the opposite end region of said reaction rod.

2. The directional assembly of claim 1, further comprising a ring gimbal with means defining the aforesaid tilt axis for said member-to-be-aimed and mounted on said roll gimbal for tilting movement about a second and mutually perpendicular tilt axis, a second torque motor carried on said roll gimbal at one side of said member-to-be-aimed, and means interconnecting said second torque motor with said ring gimbal.

3. The directional assembly of claim 1, further comprising a torque motor means for said roll gimbal.

4. The directional assembly of claim 3, further comprising pickoff means for sensing angular and rotary attitudes of said member-to-be-aimed.

5. The directional assembly of claim 4, wherein said pickoff means is affiliated with at least one of the aforesaid torque motors.

6. A directional assembly according to claim 1 wherein the means at the center of said roll gimbal includes a ball and socket.

7. A directional assembly according to claim 2 wherein the means defining the belt axis is a pin.

8. A directional assembly according to claim 2 wherein said interconnecting means is a belt and pulley.

* * * * *